US010058767B2

(12) United States Patent
Haddleton et al.

(10) Patent No.: US 10,058,767 B2
(45) Date of Patent: Aug. 28, 2018

(54) BRAKING SYSTEM FOR A RECREATIONAL RIDING-BOARD

(71) Applicant: Streetboardz International Pty Ltd, Brookvale (AU)

(72) Inventors: Anthony Haddleton, Laurieton (AU); Ivor Ackermann, Laurieton (AU)

(73) Assignee: Streetboardz International Pty Ltd, Fairlight (AU)

( * ) Notice: Subject to any disclaimer, the term of this patent is extended or adjusted under 35 U.S.C. 154(b) by 0 days.

(21) Appl. No.: 14/397,724

(22) PCT Filed: Apr. 30, 2013

(86) PCT No.: PCT/AU2013/000441

§ 371 (c)(1),
(2) Date: Oct. 29, 2014

(87) PCT Pub. No.: WO2013/163683

PCT Pub. Date: Nov. 7, 2013

(65) Prior Publication Data

US 2015/0101892 A1 Apr. 16, 2015

(30) Foreign Application Priority Data

Apr. 30, 2012 (AU) ..... 2012901754
Apr. 12, 2013 (AU) ..... 2013205467

(51) Int. Cl.
*A63C 17/00* (2006.01)
*A63C 17/14* (2006.01)
(Continued)

(52) U.S. Cl.
CPC ..... *A63C 17/1427* (2013.01); *A63C 7/108* (2013.01); *A63C 5/03* (2013.01); *A63C 17/01* (2013.01); *A63C 2017/1472* (2013.01)

(58) Field of Classification Search
CPC ..... A63C 17/1427; A63C 7/108; B62K 3/002
(Continued)

(56) References Cited

U.S. PATENT DOCUMENTS 4,076,266 A 2/1978 Krausz
4,183,546 A * 1/1980 Heilig ..... A63C 17/01 280/11.212
(Continued)

FOREIGN PATENT DOCUMENTS

EP 1103289 A1 5/2001
JP 55-008516 U1 7/1978
(Continued)

OTHER PUBLICATIONS

International Searching Authority, International Search Report for International Application No. PCT/AU2013/000441, dated Jul. 17, 2013, 6 pages, Australian Patent Office.
(Continued)

*Primary Examiner* — Christopher P Schwartz
(74) *Attorney, Agent, or Firm* — Alston & Bird LLP

(57) ABSTRACT

The present invention relates to a braking system for a recreational riding-board. The braking system includes a braking mechanism and an activating means. The braking mechanism is adapted to slow down or stop, the motion of the riding-board. The activating means is adapted to control the braking mechanism. The activating means in use is located between the middle and rear end of the riding-board.

15 Claims, 14 Drawing Sheets

(51) Int. Cl.
*A63C 7/10* (2006.01)
*A63C 5/03* (2006.01)
*A63C 17/01* (2006.01)

(58) Field of Classification Search
USPC ..... 188/16, 19, 20, 22, 29; 280/11.212, 280/87.041, 87.042
See application file for complete search history.

(56) References Cited

U.S. PATENT DOCUMENTS 4,951,958 A * 8/1990 Chao ..... B62K 3/002 188/16
5,020,621 A 6/1991 Martin
6,123,348 A * 9/2000 Miller ..... A63C 17/0046 188/22
6,488,296 B2 * 12/2002 Ireton ..... B62K 3/002 188/72.9
8,091,906 B1 * 1/2012 Chen ..... A63C 17/04 280/87.041
2002/0043777 A1 4/2002 Ireton
2004/0100056 A1 * 5/2004 Tuan ..... A63C 17/01 280/87.042
2005/0062240 A1 3/2005 Holt
2006/0108753 A1 * 5/2006 Harnden ..... A63C 17/01 280/11.27
2012/0086181 A1 * 4/2012 Kinnaman ..... A63C 17/0033 280/87.042
2013/0093151 A1 4/2013 Falanga et al.

FOREIGN PATENT DOCUMENTS

JP 60-084358 U 6/1985
JP H05-228233 A 9/1993
JP 3038615 B2 5/2000
JP 2007-111406 A 5/2007

OTHER PUBLICATIONS

European Patent Office, Extended European Search Report (EESR) for Application No. 13784981.6, dated Nov. 23, 2015, 7 pages, Germany.
M. Zardi & Co. SA, Applicant's (Streetboardz Holdings Pty Ltd.) Response to EESR for Application No. 13784981.6, dated Jun. 20, 2016, 8 pages, Switzerland.
Japan Patent Office, Notification of Reasons for Refusal, including Feb. 16, 2017 Search Report, for Application No. 2015-509259, drafted Mar. 28, 2017, 40 pages, Japan.

* cited by examiner

BRAKING SYSTEM FOR A RECREATIONAL RIDING-BOARD

CROSS REFERENCE TO RELATED APPLICATIONS

This application is a National Stage Application, filed under 35 U.S.C. § 371, of International Application No. PCT/AU2013/000441, filed Apr. 30, 2013, which claims priority to Australian Application No. 2012901754, filed Apr. 30, 2012 and Australian Application No. 2013205467, filed Apr. 12, 2013; the contents of all of which as are hereby incorporated by reference in their entirety.

BACKGROUND

Related Field

This invention broadly relates to a braking system for recreational riding-boards. In particular, the invention relates to a braking system for recreational riding-boards capable of enabling a rider to maintain balanced during braking.

Description of Related Art

It is desirable in the board-riding industry to provide riding-boards that are safe and versatile. One way to achieve this is to provide a braking system which enables the rider to slow down or stop particularly when riding downhill.

Existing braking systems have a shortcoming in that when the brake is applied, the rider is likely to be thrown off balance due to forward momentum. Hence riding-boards equipped with such a braking system are actually more dangerous to ride.

It is an object of the present invention to provide a braking system which is capable of ameliorating or overcoming the above shortcoming or which Will at least provide a useful alternative.

BRIEF SUMMARY

According to one aspect of the present invention there is provided a braking system for a recreational riding-board, the braking system including:

a braking mechanism adapted to slow down or stop the motion of the riding-board; and an activating means adapted to control the braking mechanism;

wherein the activating means in use is located between the middle and rear end of the riding-board.

In a preferred embodiment, the activating means has a first end adapted in use to be held by a rider and a second end operatively connected to the braking mechanism.

Preferably, the activating means in use in located in the vicinity of the rear end of the riding-board.

In a preferred embodiment, the activating means is removably attached to the riding-board. The activating means may include a pliable tether. When subjected to a pulling force exerted by the rider, the activating means is preferred to be capable of changing from a slack state to a tensioned state.

Preferably, the tensioned activating means is capable of providing the rider with leverage. As such, the tensioned activating means is capable of activating the braking mechanism and bracing the rider against forward momentum simultaneously.

Preferably, the tensioned tether is capable of inhibiting further forward momentum of the rider caused by braking. In a first embodiment, the recreational riding-board is a skateboard. The skateboard includes an aperture. Preferably, the aperture is located toward the rear of the riding-board. The aperture is preferred to provide a fulcrum against which the tether bears.

Preferably, the tether includes a first portion including the first end and being disposed on one side of the skateboard. The first end is preferred to include a handle adapted to facilitate gripping by the rider. The tether is preferred to include second portion including the second end and a third portion including a third end, both of the second and third portions being disposed on an opposing side of the riding-board.

Optionally, the first portion of the tether is covered by a telescopic sheath extending from the upper surface of the skateboard.

Alternatively, the activating means is in the form of a rigid stick, rod or wire.

The braking mechanism may include one or more levers. Preferably, the braking mechanism includes a pair of levers, each being connected to a truck of the skateboard via a pivot hinge. Each of the second and third ends of the tether is connected to one end of a corresponding lever. The other end of each lever is preferred to be attached to a braking means adapted in use to engage a rear wheel of the skateboard. Each braking means may be in the form of a brake pad.

The braking mechanism may include an additional pair of levers for the front wheels of the skateboard. In such an embodiment, the tether includes fourth and fifth portions, each having an end connected to the corresponding additional lever.

Each of the levers may be a cam lever or biased.

In another embodiment, the recreational riding-board includes a snowboard or sandboard. The snowboard or sandboard may include one or more apertures adapted to accommodate the braking mechanism.

The braking mechanism is preferred to include a lever which is tied at one end to the tensioned tether and pivotally hinged toward the rear of the riding-board. The lever is preferred to follow a curve which conforms to a bent end of the riding-board.

Preferably, the lever includes or is connected to a blade at another end, the blade being adapted in use to plough into or through snow or sand. More preferably, the lever is pivotally connected to a holder which is affixed to the snowboard or sandboard.

The braking mechanism is preferred to include an impediment which in combination with the holder is capable of restricting pivotal movement of the lever. As such, the extent to which the blade, ploughs into the snow or sand may be controlled by installation or removal of the impediment. The impediment is preferably in the form of a pin.

In another embodiment, the riding-board has two apertures each in the form of a slot located toward the rear end of the snowboard or sandboard. In this embodiment, the lever is U-shaped having a pair of prongs adapted in use to plough into or through snow or sand. Each prong is preferred to be aligned with the corresponding slot.

Preferably, each prong has one or more fingers adapted to plough into the snow or sand. Optionally, the or each finger is attached to an elongate snowplough or sandplough.

Preferably, the tensioned tether is capable of pivoting the lever from a retracted position where the prongs are not in contact with the snow or sand to a braking position where the prongs are lowered to plough into the snow or sand. The lever may include biasing means such that it is biased back into the retracted position when not in use.

BRIEF DESCRIPTION OF THE FIGURES

The invention may be better understood from the following non-limiting description of preferred embodiments, in which.

DETAILED DESCRIPTION OF VARIOUS EMBODIMENTS

Different embodiments of the braking system of the present invention are intended to be applicable to different recreational riding-boards such as skateboards and snowboards which are illustrated and described herein. However, it should be noted that the braking system of the present invention may be applied to other types of recreational riding-boards such as sandboards. It should also be noted that the braking system of the present invention is retrofittable onto a used riding-board.

Figure 1:
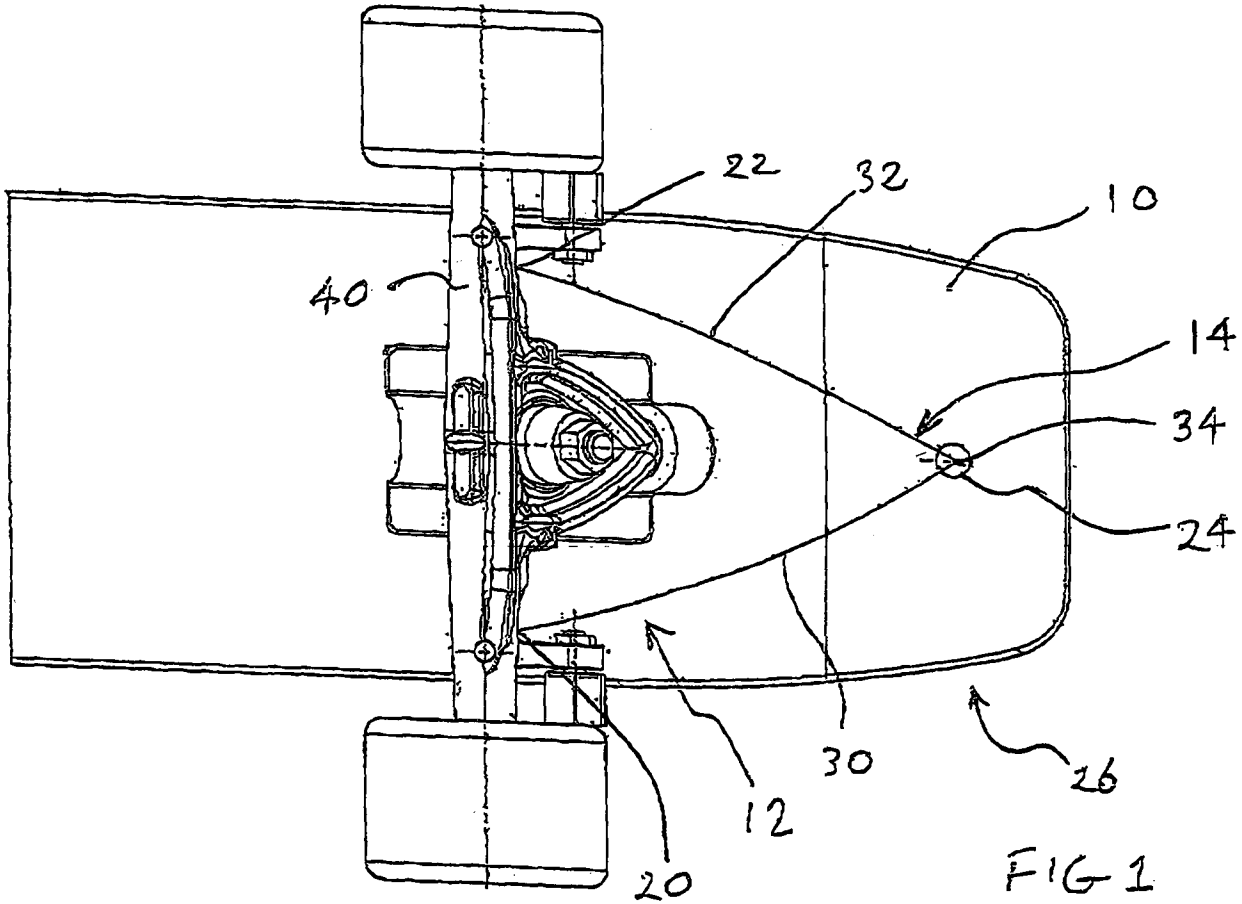
FIG. 1 is a bottom view of the rear of a skateboard with a braking system in accordance with a first embodiment of the present invention mounted on the rear wheels.
Figure 2:
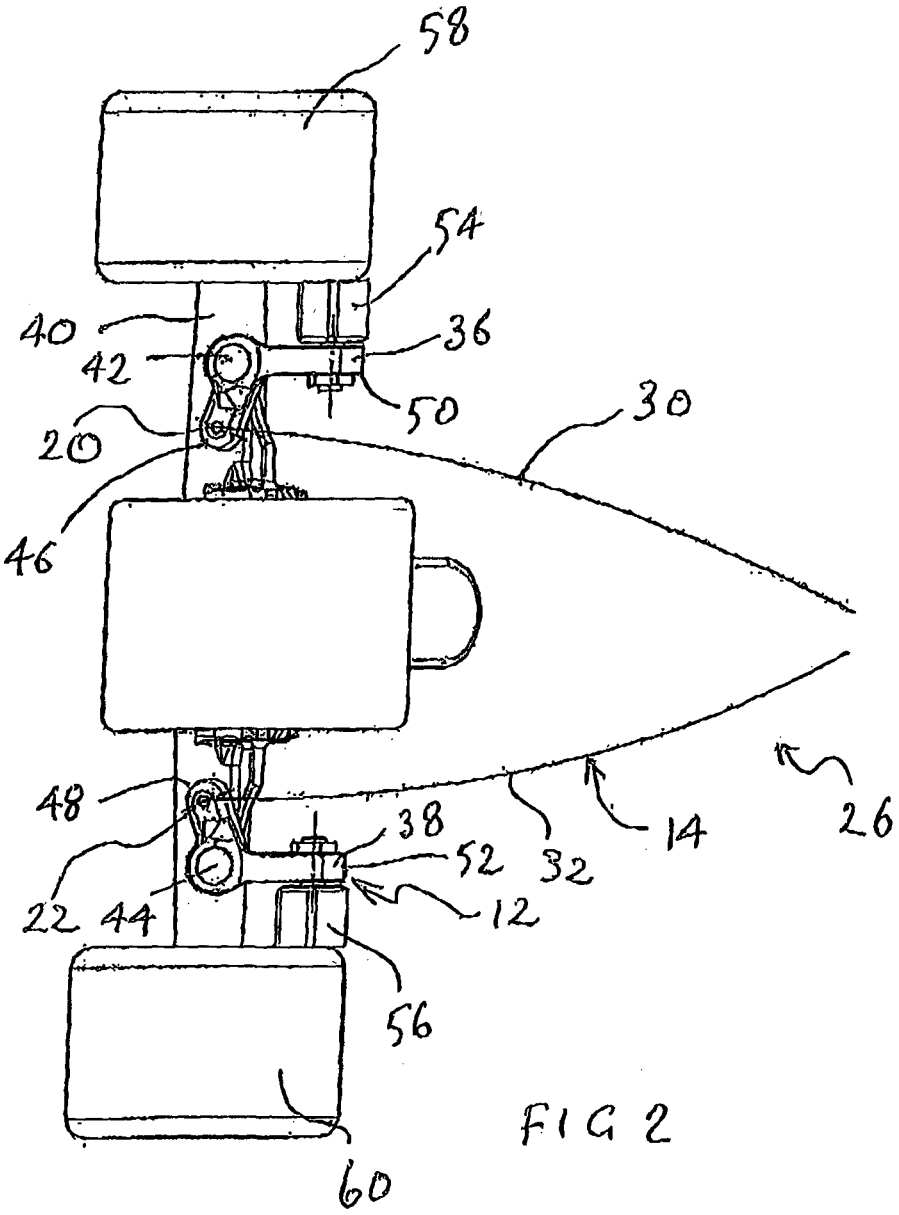
FIG. 2 is a plan view of the braking system of FIG. 1 mounted on the truck of the skateboard with the board removed.
Figure 3:
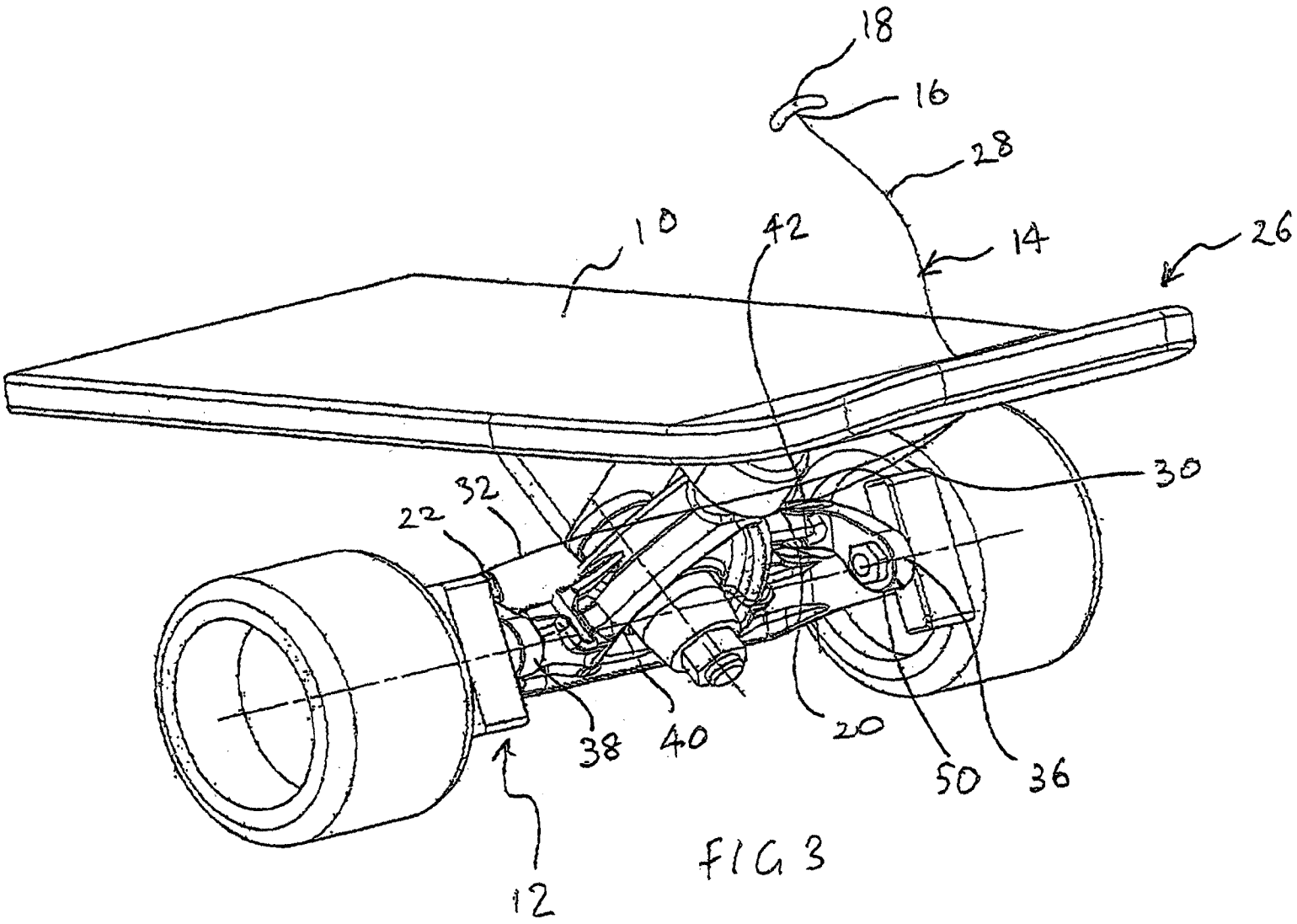
FIG. 3 is a perspective view of the braking system of FIG. 1 mounted onto the rear of the skateboard.

Referring to FIGS. 1, 2 and 3, a first embodiment of a braking system 12 is shown being mounted on a skateboard 10. The braking system 12 includes a braking mechanism and an activating means which is in the form of a pliable tether 14. The braking mechanism is provided in order to enable a rider (not shown) to slow down or stop the motion of the skateboard. It should be noted that the activating means in use is located between the middle and rear end of the riding-board. Generally speaking, better control would be attained by having the activating means located towards the rear end of the riding-board. However, the ideal location of the activating means may vary depending on the landscape on which skating takes place as the centre of gravity shifts and hence it is contemplated that the activating means may be provided at more than one location.

As best shown in FIG. 3, the tether 14 has a first end 16 with a handle 18 for gripping by a rider, and second and third ends 20 and 22 operatively and respectively connected to the braking mechanism (see below for details).

As best shown in FIG. 1, the skateboard 10 has an aperture 24 which is located toward the rear 26 of the skateboard 10. The tether 14 includes a first portion 28 (see FIG. 3) having the first end 16 and being disposed on an upper side of the skateboard 10. The 15 tether 14 also has a second portion 30 with the second end 20 and a third portion 32 with a third end 22. Both of the second and third portions 30 & 32 are disposed on an underside of the skateboard 10.

The second and third portions 30 and 32 meet at a meeting point 34 and merge to become the first portion 28 which extends through the aperture 24 being exposed on the upper side of the skateboard 10. In use, the aperture 24 provides a fulcrum against which the tether 14 bears.

As best shown in FIGS. 1 and 3, the braking mechanism includes a pair of levers 36 and 38. Each of the lever 36, 38 is connected to a truck 40 of the skateboard 10 via a pivot hinge 42, 44 (see FIG. 2). Each end 20, 22 of the tether 14 is connected to one 25 end 46, 48 of a corresponding lever 36, 38. The other end 50, 52 of each lever 36, 38 is attached to a braking means in the form of a brake pad 54, 56 which in use is configured to engage a rear wheel 58, 60 of the skateboard 10.

In use, the tether 14 is generally in a slack state as best shown in FIG. 3. When pulled by the rider, the tether 14 changes from the slack state to a tensioned state. As a result, the levers 36 & 38 are pulled to pivot about the hinges 42 & 44 thereby causing the brake pads 54 & 56 to engage the wheels 58 & 60 respectively. The tensioned tether 14 also enables the rider to gain leverage and maintaining the pulling force. As such, the rider is able to activate the braking mechanism and bracing him or her self against forward momentum simultaneously. Furthermore, the tensioned tether 14 is capable of inhibiting further forward momentum of the rider caused by braking.

Figure 4:
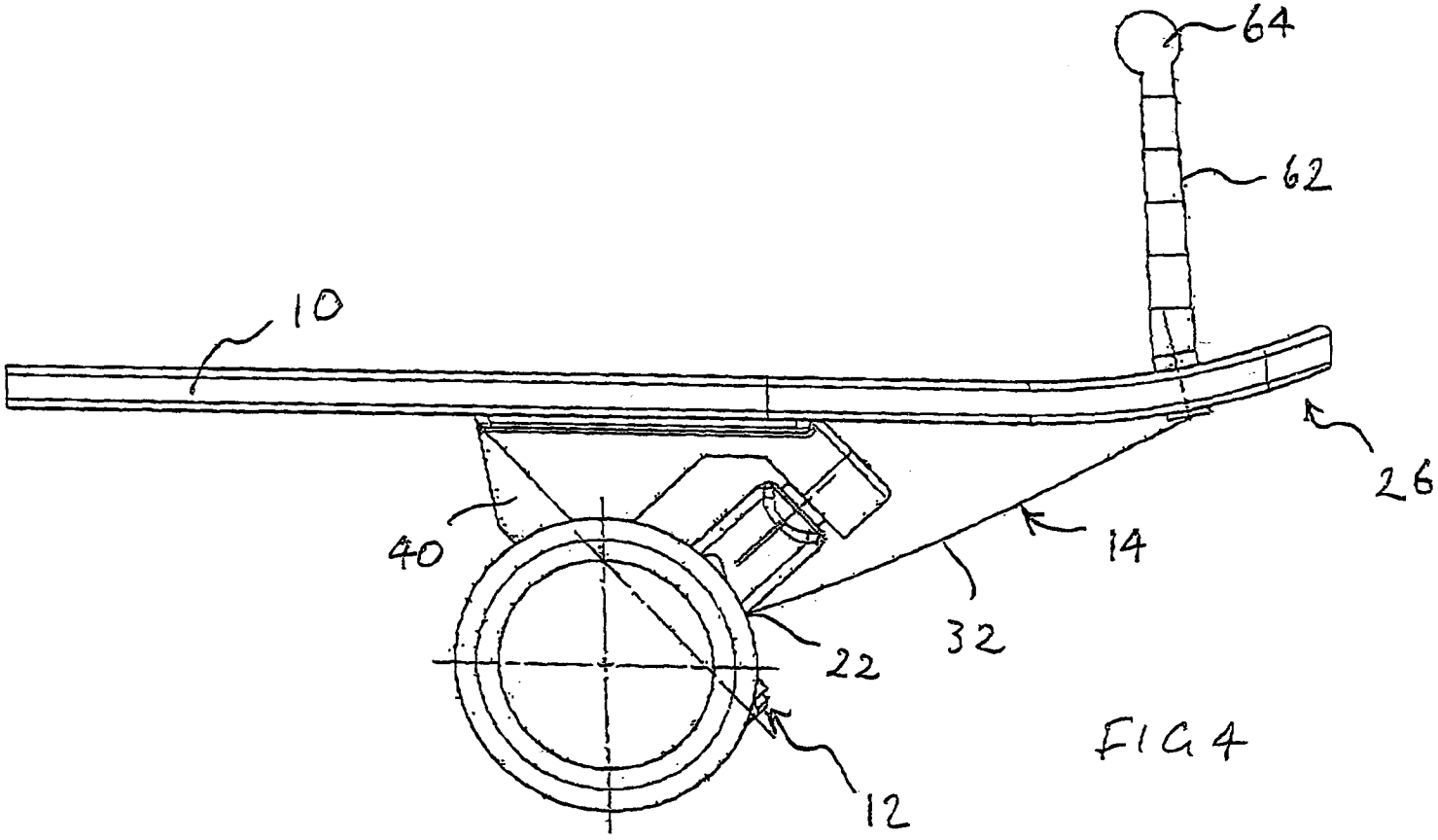
FIG. 4 is a side view of the braking system of FIG. 1 mounted to the rear of the skateboard, the tether of the braking system covered by a telescopic sheath.
Figure 4A:
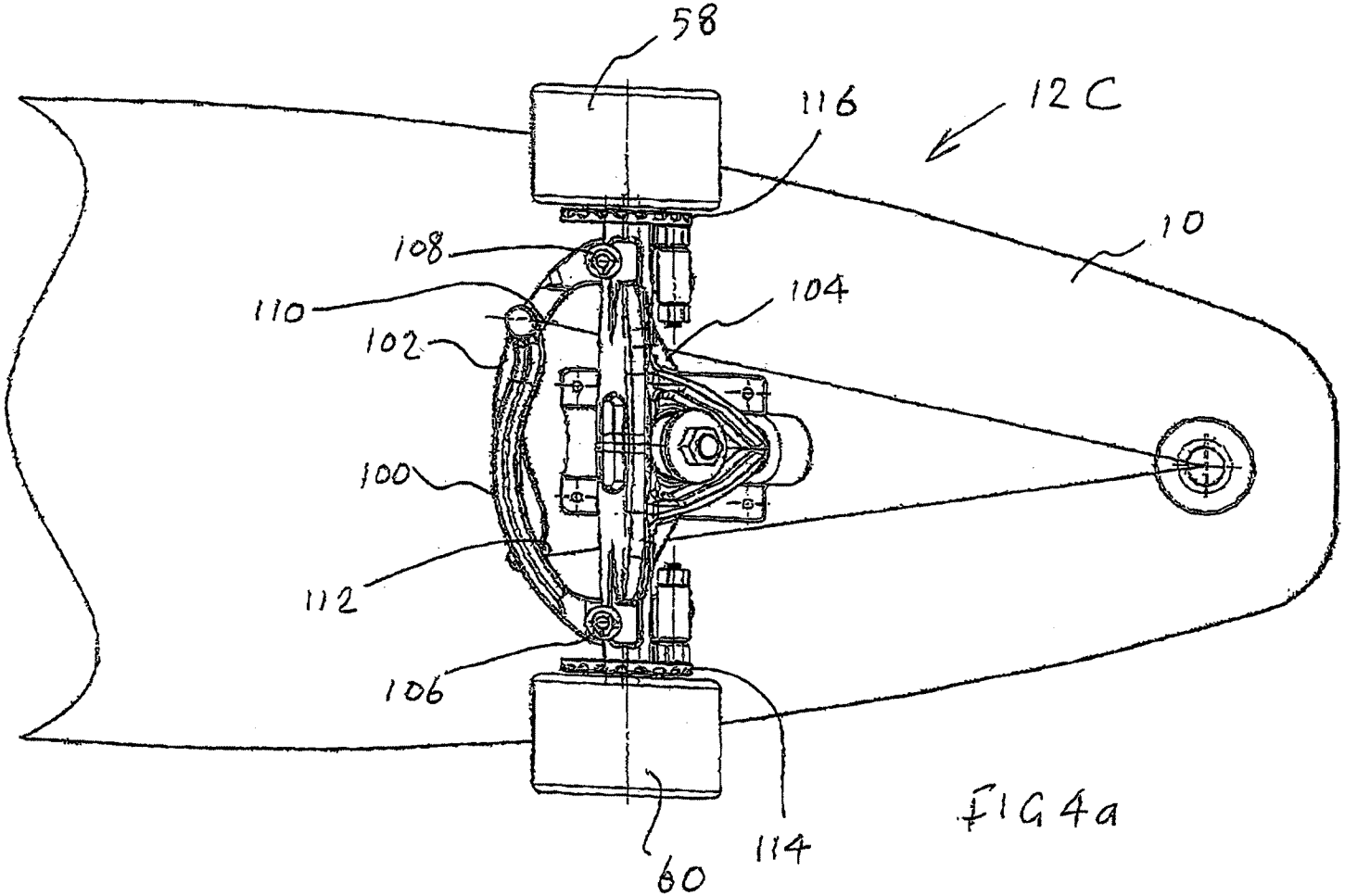
FIG. 4*a* is a bottom view of the rear of the skateboard with a braking system in accordance with another embodiment of the present invention mounted on the rear wheels.
Figure 5:
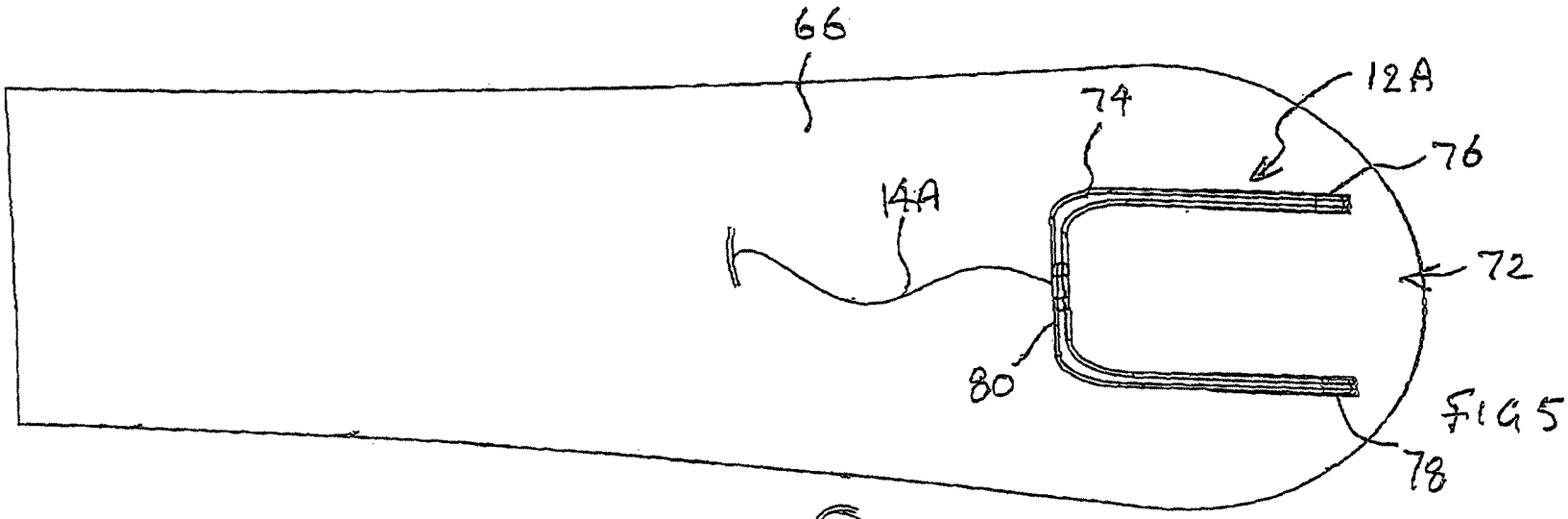
FIG. 5 is a plan view of a braking system in accordance with a further embodiment of the present invention mounted on a snowboard or sandboard.
Figure 6:
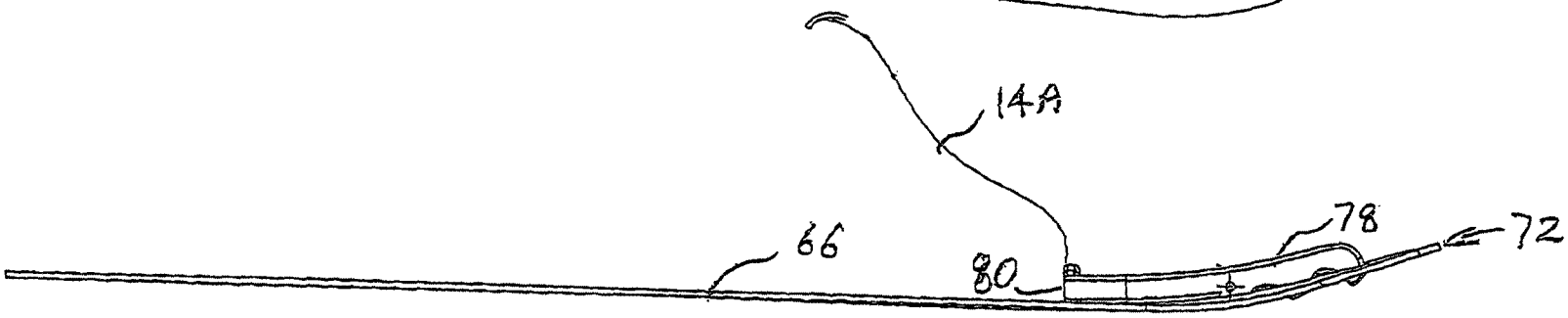
FIG. 6 is a side view of the braking system of FIG. 5 mounted on the snowboard or sandboard with the lever in a retracted position.
Figure 7:
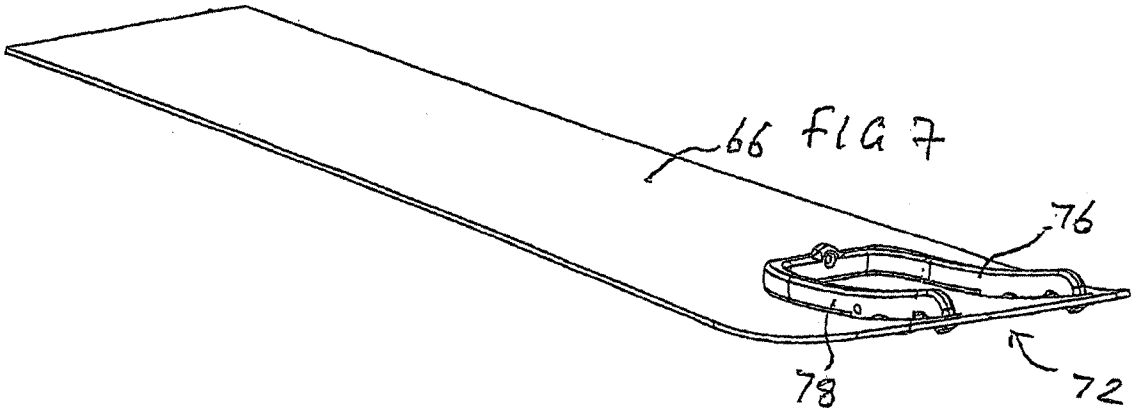
FIG. 7 is a perspective view from the rear of the snowboard or sandboard with the braking system of FIG. 5 having the lever in the retracted position.
Figure 8:
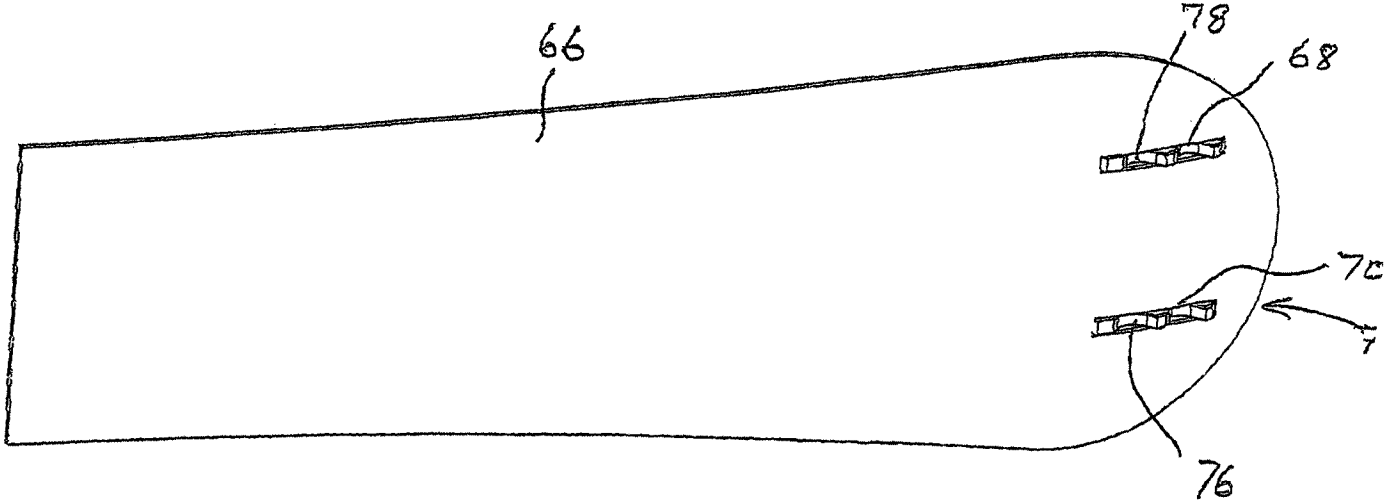
FIG. 8 is a perspective view from the bottom of the snowboard or sandboard with the lever of the braking system of FIG. 5 in the retracted position through the slots of the snowboard.

Referring to FIG. 4, as an alternative, the first portion 28 of the tether 14 is covered by a telescopic sheath 62 which extends from the upper surface of the skateboard 10 all the way to a handle which is in the shape of a spherical knob 64.

It is contemplated that the braking mechanism may have an additional pair of levers for the two front wheels (not shown) of the skateboard 10. In such an embodiment, the tether 14 has fourth and fifth portions, each having an end connected to a corresponding additional lever which is affixed to the front truck.

Also, although not shown in the accompanying drawings, each of the levers may be a cam lever or spring loaded such that once the rider stops exerting a pulling force on the tether 14 via the handle 18, the levers 36 and 38 will pivot back to the original positions thereby effecting disengagement of the brake pads 54 & 56 from the wheels 58 & 60.

Referring to FIG. 4, another embodiment of the braking system 12C with a different braking mechanism is shown. This braking mechanism has two levers 100 & 102, each being connected to a truck 104 of the skateboard 10 via a pivot hinge 106, 108. Each of tether portions 110 & 112 is connected to one end of the corresponding lever 100, 102. Each lever 100, 102 when pulled, is designed to cause engagement of a brake pad 114, 116 with the corresponding wheel 58, 60 thereby effecting braking of the skateboard 10.

Turning now to FIGS. 5 to 9, a further embodiment 12A of the braking system is shown being mounted on a snowboard 66. The snowboard 66 has two apertures 68 & 70 each in the form of a slot located toward the rear end 72 of the snowboard 66. The rear end 72 of the snowboard is designed to bend upwards which means that when in use, the rear end 72 is not in contact with the snow surface.

In the present embodiment, the braking mechanism has a tether 14A which is tied to a U-shaped lever 74 which is located toward the rear end 72 of the snowboard 66. The lever 74 follows a curve which conforms to the bend toward the rear end 72 of the snowboard 66. The U-shaped lever 74 has a pair of prongs 76 & 78. The middle of each prong 76, 78 is pivotally hinged to the snowboard 66 and spring loaded. As such, when the front end 80 of the lever 74 is lifted from a retracted position by the pulling force exerted by the tensioned tether 14A, the prongs 76 & 78, which are aligned with corresponding slots 68 & 70, are pivoted into a braking position where the prongs are lowered to plough into the snow through the slots 68 & 70. The lever 74 is spring loaded such that it is biased back into the retracted position when the pulling force is no longer exerted by the tether 14.

Figure 9:
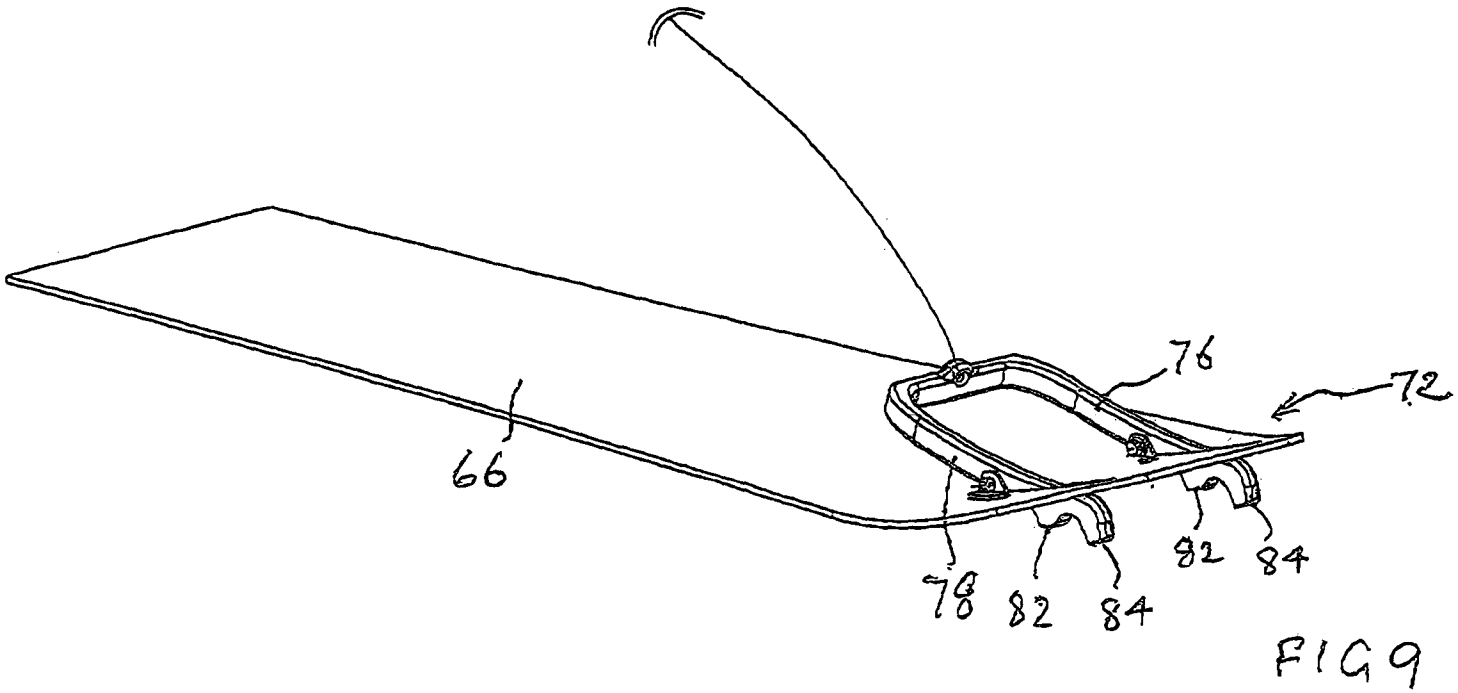
FIG. 9 is a perspective view of the snowboard or sandboard with the braking system of FIG. 5 with the lever in a braking position.
Figure 10:
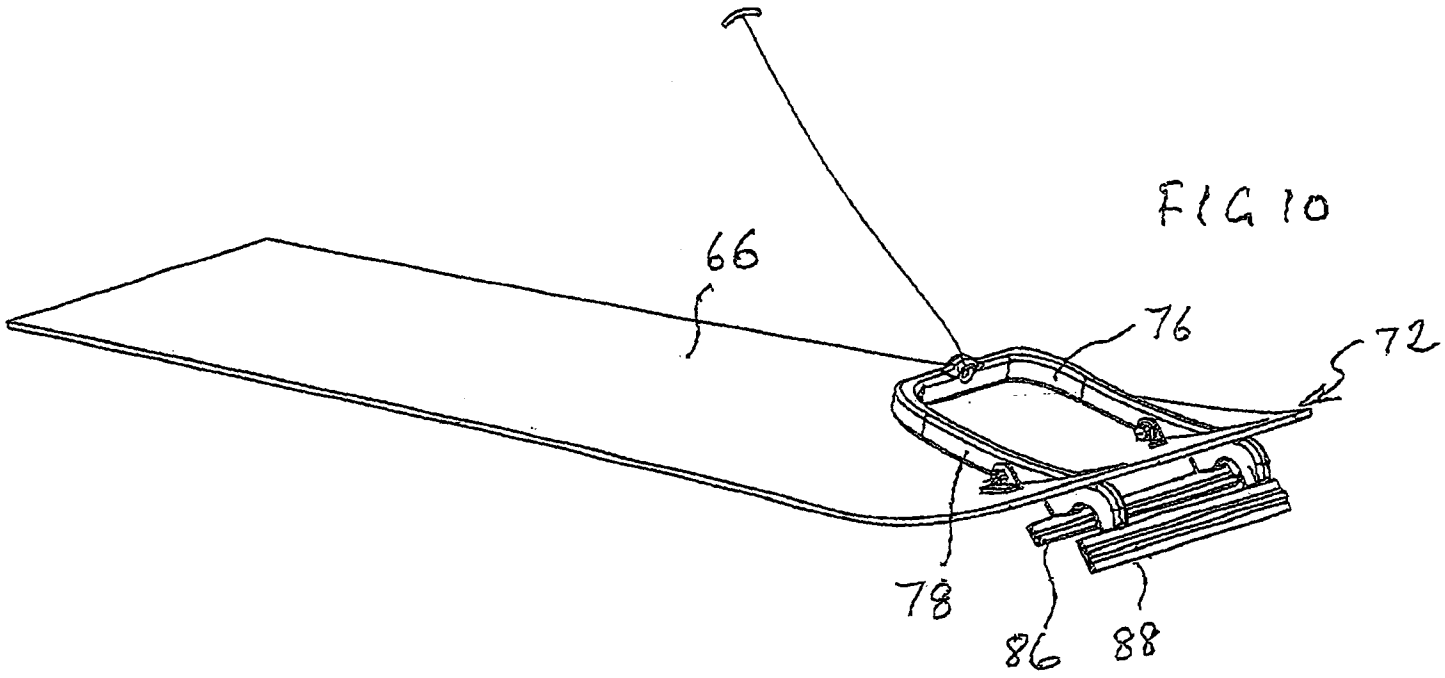
FIG. 10 is a perspective view of the snowboard or sandboard with the braking system of FIG. 5 with a modified lever.
Figure 11:
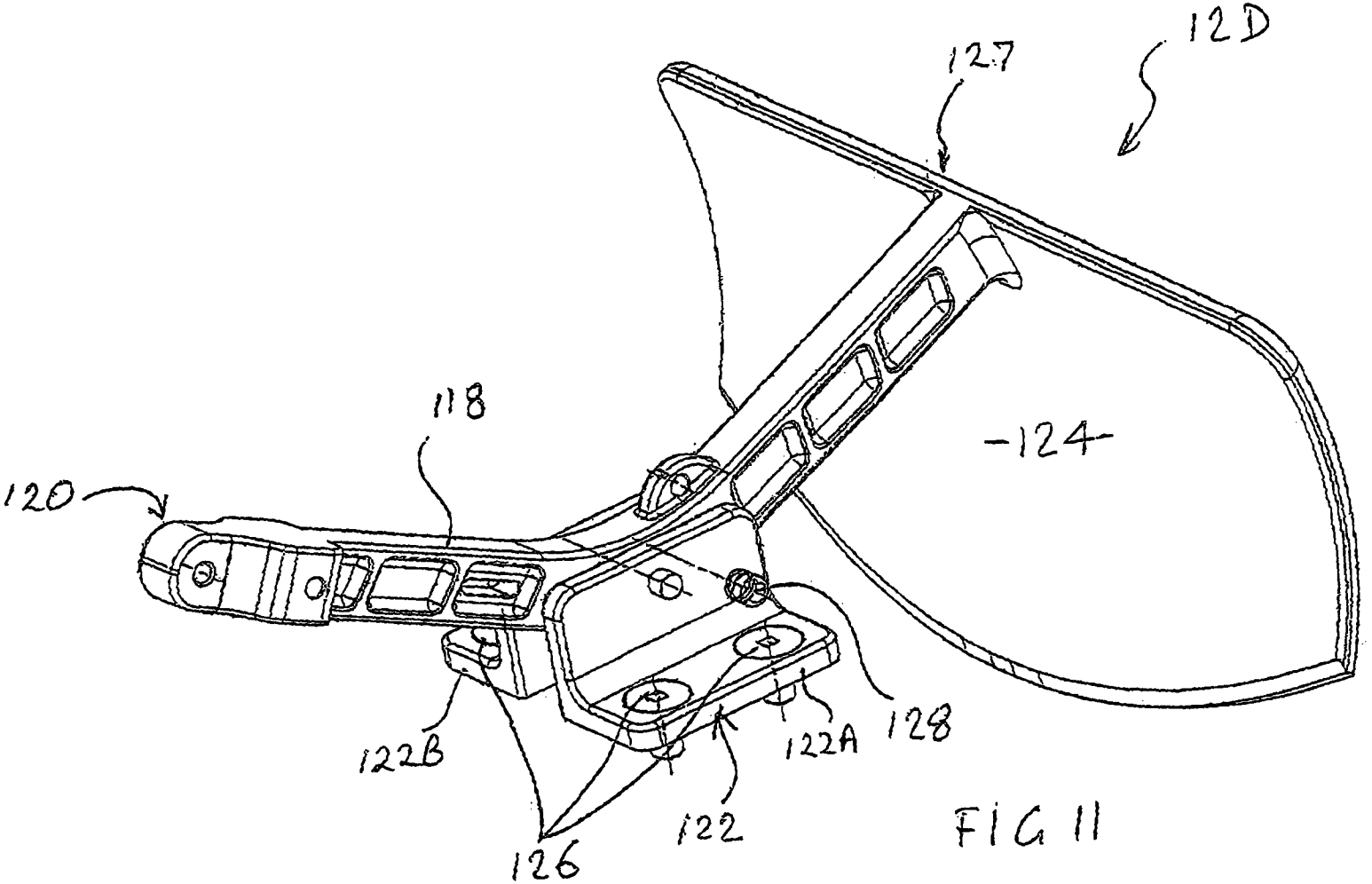
FIG. 11 is a perspective view of a braking system for a snowboard or sandboard in accordance with a yet further embodiment -With an impediment in an operating position.
Figure 12:
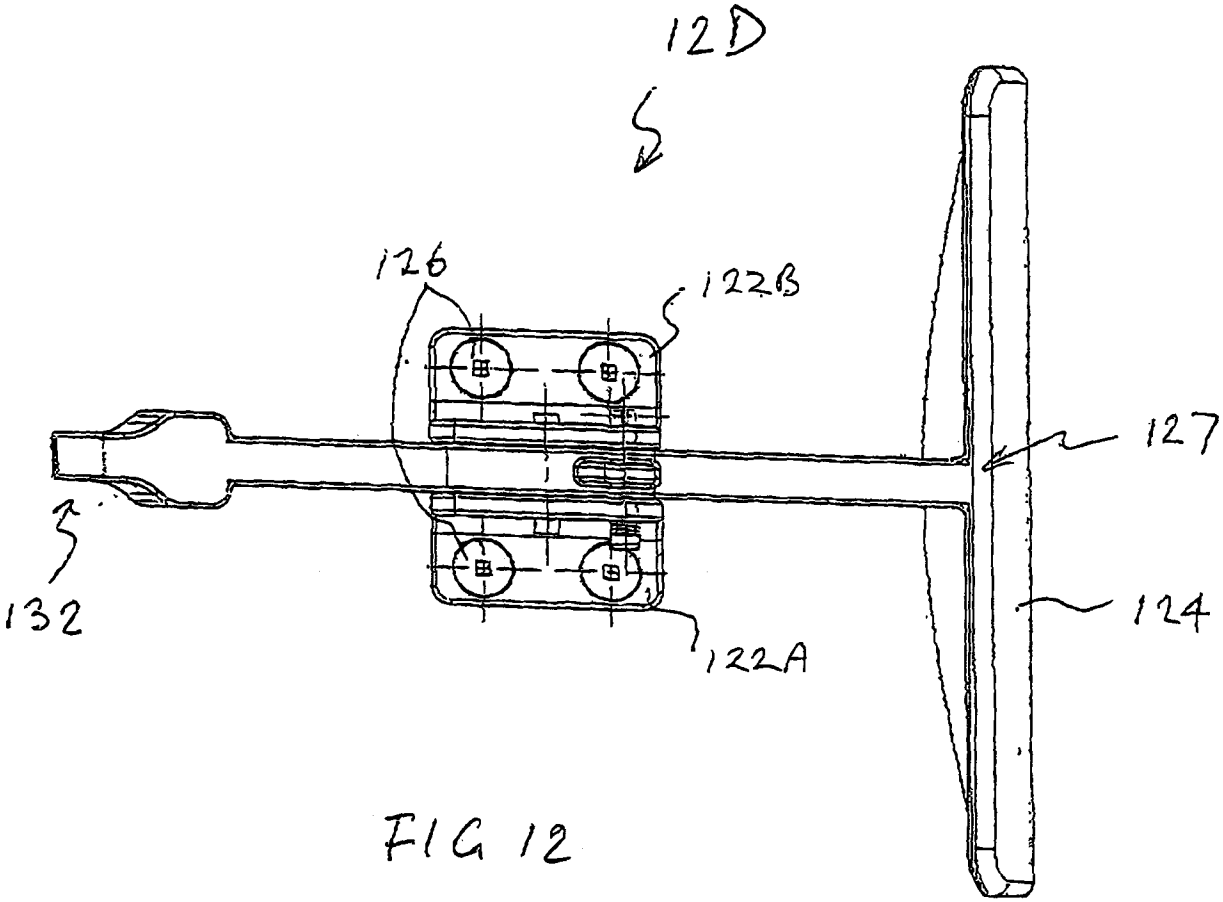
FIG. 12 is a plan view of the braking system of FIG. 11.

As best shown in FIG. 9, each prong 76, 78 has two fingers 82 & 84 which in use plough into the snow in order to slow down or stop the forward motion of the snowboard 66. Referring to FIG. 10, as an alternative, each finger 82, 84 is attached to an elongate snowplough 86, 88 which is configured to provide an enhanced ploughing effect.

Referring to FIGS. 11 to 15, a yet further embodiment of the braking system 12D with a different braking mechanism is provided. Another embodiment of a snowboard (not shown) is provided having only one aperture in the form of a slot adapted to accommodate this braking mechanism.

Referring to FIGS. 11 to 15, in this embodiment, the braking mechanism has a lever 118 which is tied at one end 120 to a tether (not shown) and pivotally hinged toward the rear of the snowboard (not shown) via a holder 122. The lever 118 follows a curve which conforms to a bent rear end of the snowboard.

The lever 118 is connected to a curved blade 124 at one end 127. The blade 124 is adapted in use to plough into or through snow (or sand in the case of the riding-board being a sandboard). The lever 118 is pivotally connected to the holder 122 which is affixed to the snowboard via fixing means 126 which may be rivets or screws. Similar to the previously described embodiment, the lever 118 is equipped with biasing means such that it is biased back into the retracted position when not in use.

Figure 13:
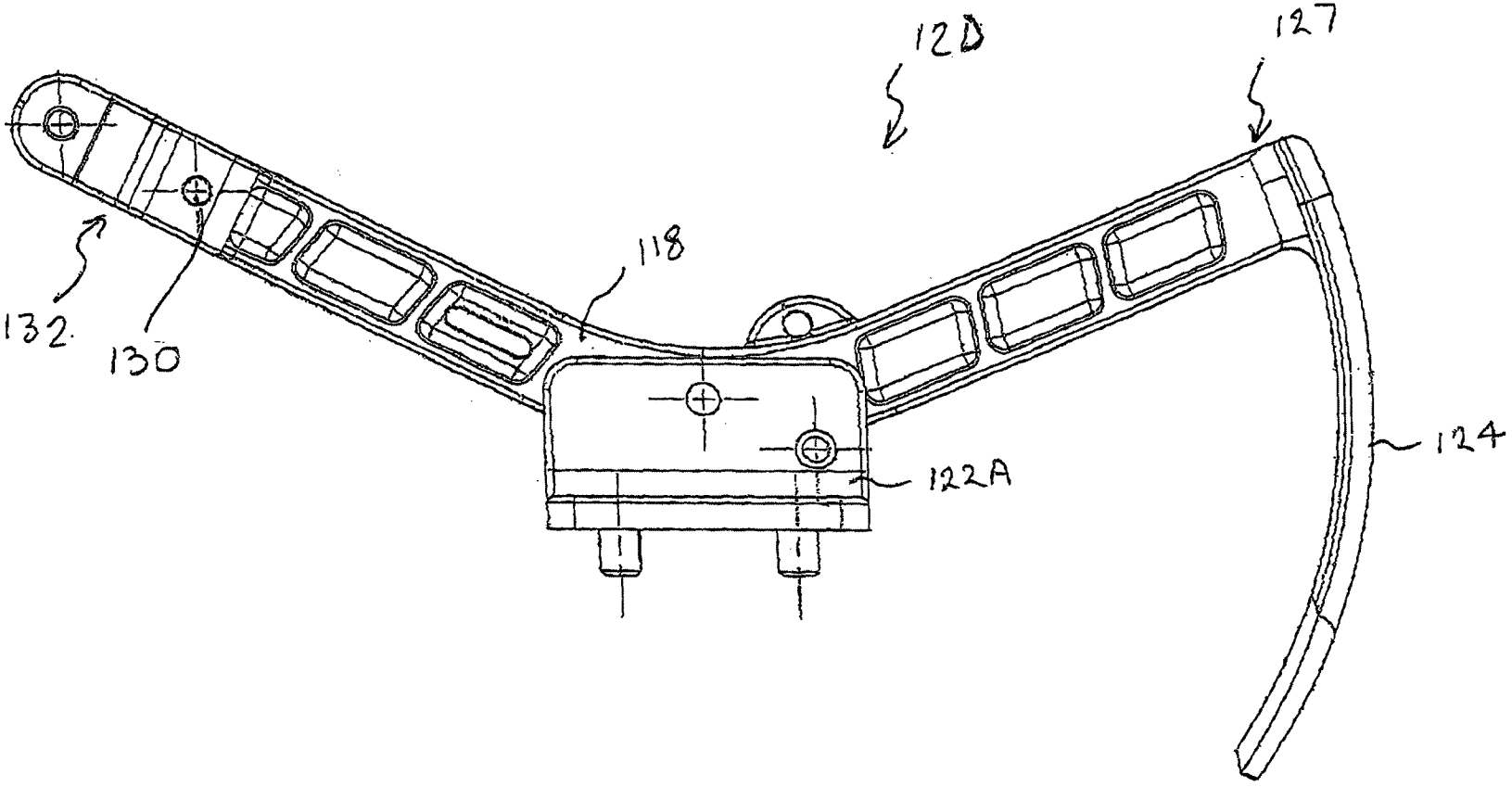
FIG. 13 is a side view of the braking system of FIG. 11.
Figure 14:
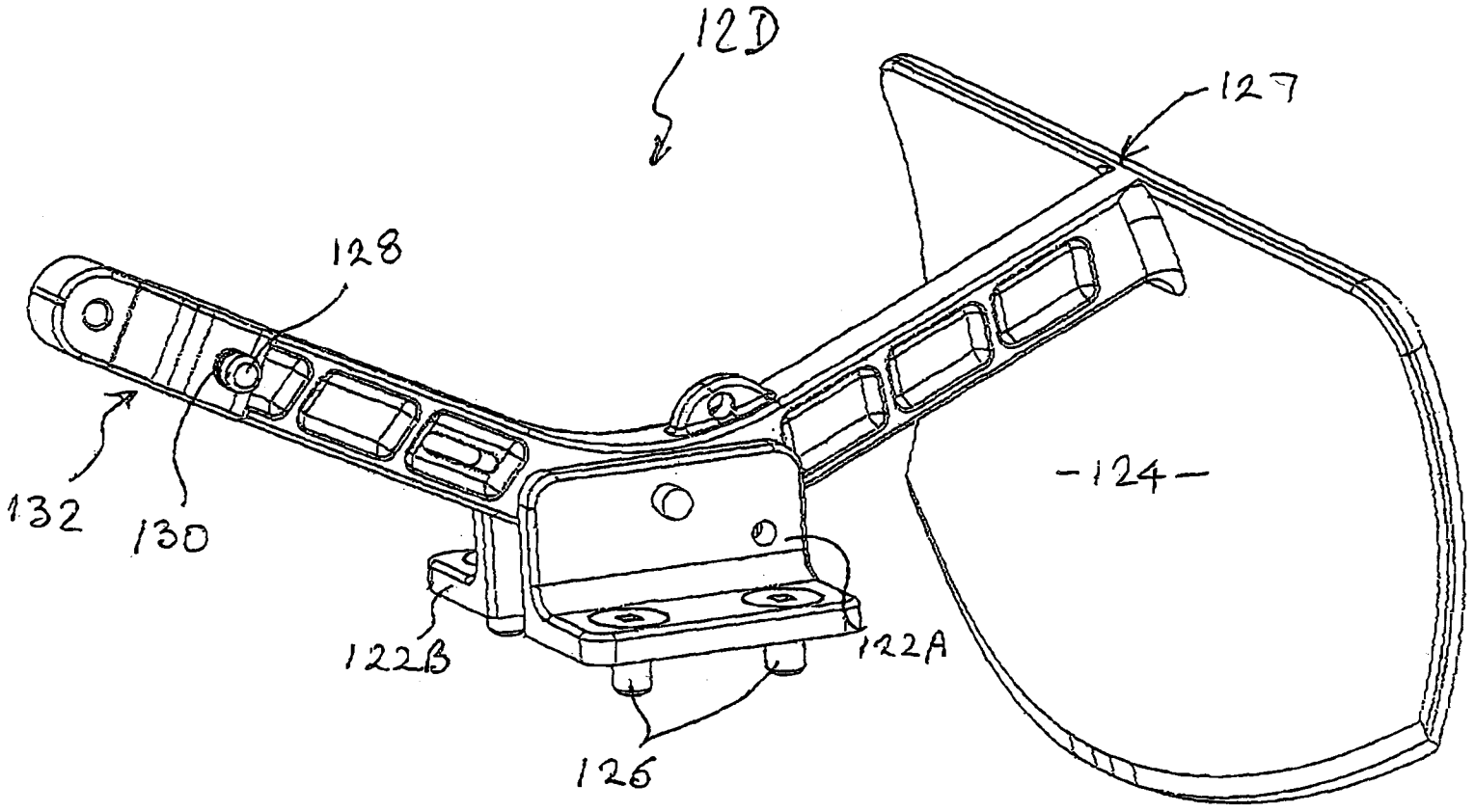
FIG. 14 is a perspective view from one side of the braking system of FIG. 11 with the impediment in a non-operating position.
Figure 15:
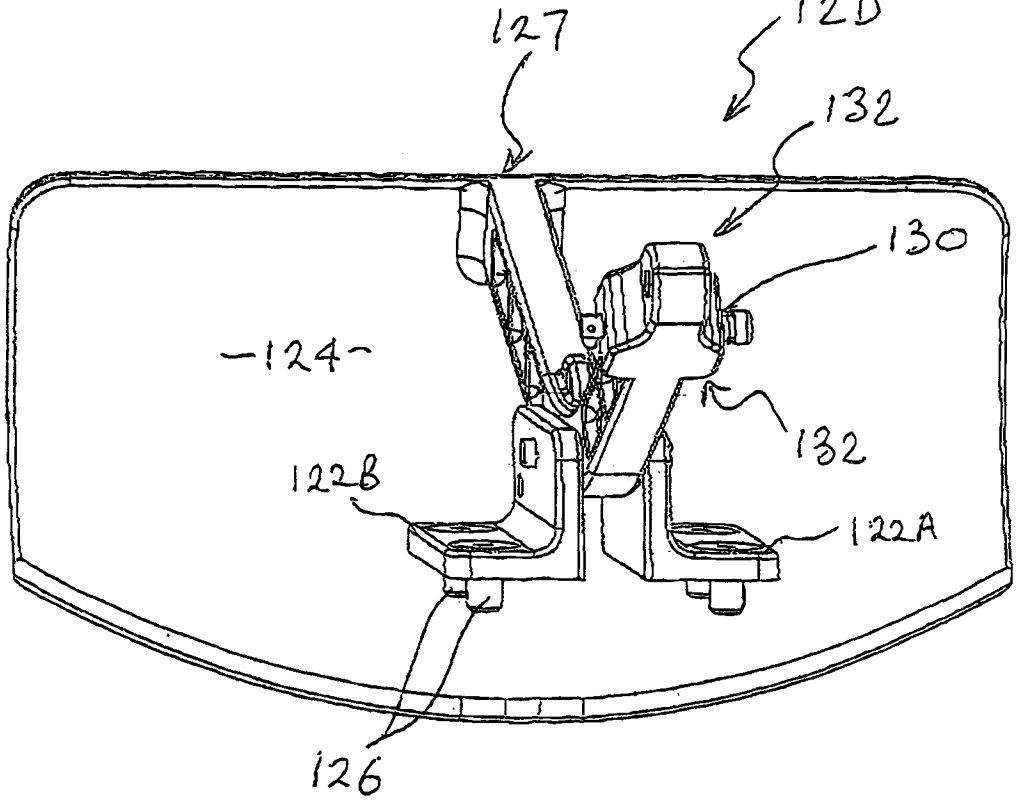
FIG. 15 is a perspective view from an end, of the braking system of FIG. 11 with the impediment in a non-operating position.

As shown in FIGS. 11 to 15, the holder 122 has two portions 122A & 122B which are respectively affixed to the surface of the snowboard. The braking mechanism has an impediment in the form of a pin 128 which in combination with the holder 122 is capable of restricting pivotal movement of the lever 118. As such, the extent to which the blade 124 ploughs into the snow may be controlled by installation or removal of the pin 128. The pin 128 which is designed in use to go through holes provided in the holder portions 122A & 122B. Once put in place, the pin 128 functions to prevent the level 118 from pivoting beyond 45 degrees to the horizontal, for example, such that the blade 124 in turn is restricted from ploughing deep into the snow. If desired, the pin 128 may be removed from the holder 122 in order to allow the blade 124 to plough deep into the snow. Turning to FIGS. 13 to 15, the removed pin 128 may be placed and stored in a hole 130 provided at the other end 132 of the lever 118. Now that preferred embodiments of the present invention have been described in some detail, it will be apparent to a skilled person in the art that the braking system of the present invention may offer at least the following advantages:

1. it enables braking of the riding-board as well as enabling the rider to brace his or her self such that he or her won't lose balance;
2. it provides the rider with leverage during braking such that the rider doesn't get thrown off balance by the forward momentum resulting from braking;
3. it facilitates safe board-riding;
4. it makes it safer and easier for starters to learn to ride a recreational board;
5. it is easy to install/retrofit and use;
6. in the case of a snowboard, it allows the user to adjust the braking mechanism to suit different snow conditions Those skilled in the art will appreciate that the invention described herein is susceptible to variations and modifications other than those specifically described. All such variations and modifications are to be considered within the scope and spirit of the present invention the nature of which is to be determined from the foregoing description.

The invention claimed is:

1. A braking system for a recreational riding-board, the braking system comprising:

a braking mechanism configured to at least one of slow down or stop the motion of the riding-board; and an activating means in the form of a pliable tether configured to control the braking mechanism, wherein:

the braking mechanism comprises at least one brake pad and at least one lever, the lever having a first end and a second end;

the lever is connected to a truck of the riding-board via a pivot hinge located intermediate the first and the second end of the lever;

the lever is connected at the second end to the brake pad;

the pliable tether is removably attached to the riding-board via connection of the pliable tether to the first end of the lever; and the pliable tether is configured to be tensioned when pulled so as to: (1) directly and instantaneously activate the brake pad of the braking mechanism via pivoting of the lever about the pivot hinge, and (2) simultaneously brace a rider against forward momentum.

2. The braking system of claim 1, wherein the tether comprises:

a first end configured, in use, to be held by a rider; and a second end operatively connected to the braking mechanism via the connection to the first end of the lever.

3. The braking system of claim 2, wherein the tether comprises a first portion including the first end, the first end including a handle configured to facilitate gripping by the rider and being disposed on one side of the riding-board.

4. The braking system of claim 3, wherein the tether comprises a second portion including the second end and a third portion including a third end, both of the second and third portions being disposed on an opposing side of the riding-board relative to the first portion.

5. The braking system of claim 3, wherein the first portion of the tether is covered by a telescopic sheath extending from the upper surface of the skateboard.

6. The braking system of claim 1, further comprising a means located between the middle and rear end of the riding-board, said means providing a fulcrum for activation of the braking mechanism by the tether.

7. The braking system of claim 6, wherein:

the recreational riding-board is a skateboard; and the means providing a fulcrum for activation of the braking mechanism is an aperture.

8. The braking system of claim 7, wherein the aperture is located toward the rear end of the riding-board so as to provide the fulcrum against which the tether bears.

9. The braking system of claim 1, wherein the tether, in use, is located in the vicinity of the rear end of the riding-board.

10. The braking system of claim 1, wherein the tensioned tether is configured for inhibiting further forward momentum of the rider caused by braking.

11. The braking system of claim 1, wherein part of the activating means is in the form of at least one of a stick, a rod, or a wire.

12. The braking system of claim 1, wherein the the one or more levers are pivotally hinged, via the pivot hinge, toward the rear of the riding-board.

13. The braking system of claim 1, wherein:

the at least one brake pad comprises two brake pads;

the at least one lever comprises two levers;

the pliable tether includes a first portion configured, in use, to be held by a rider; and the pliable tether includes a second portion having separate and distinct first and second ends thereof, the first end of the second portion being connected to the first end of a first of the two levers, the second end of the second portion being connected to the first end of a second of the two levers.

14. A braking system for a recreational riding-board, the braking system comprising:

a braking mechanism configured to at least one of slow down or stop the motion of the riding-board; and an activating means in the form of a pliable tether configured to control the braking mechanism, wherein:

the braking mechanism comprises two brake pads and two levers, each lever having a first end and a second end;

each of the two levers is connected to a truck of the riding-board via respective pivot hinges, each pivot hinge being located intermediate the first and the second ends of the respective two levers;

each of the two levers is connected at the second end to a respective one of the two brake pads;

the pliable tether is configured to be tensioned when pulled so as to: (1) directly and instantaneously activate the two brake pads of the braking mechanism via pivoting of each of the two levers about their respective pivot hinges, and (2) simultaneously enable bracing of a rider against forward momentum, the pliable tether has at least one end portion that comprises a first end and a second end, the first end being attached to the first end of one of the two levers, the second end being attached to the first end of the other of the two levers.

15. The braking system of claim 14, wherein the two brake pads are further simultaneously activated in response to pivoting of each of the two levers about their respective pivot hinges.

* * * * *